United States Patent [19]

Dampney

[11] Patent Number: 4,730,612

[45] Date of Patent: Mar. 15, 1988

[54] HELMET WITH AUXILIARY, ELECTRICALLY OPERATED SERVICE

[75] Inventor: Ian T. Dampney, London, England

[73] Assignee: Helmets Limited, Hertfordshire, England

[21] Appl. No.: 842,367

[22] Filed: Mar. 19, 1986

[30] Foreign Application Priority Data

Mar. 27, 1985 [GB] United Kingdom ..... 8507916

[51] Int. Cl.[4] ..... A62B 18/00

[52] U.S. Cl. ..... 128/201.24; 128/201.25; 2/171.3

[58] Field of Search ..... 128/200.27, 200.28, 128/201.22, 201.23, 201.24, 201.25, 205.25; 2/2, 1 A, 6, 8, 171.3, 436

[56] References Cited

U.S. PATENT DOCUMENTS

| | | | |
|---|---|---|---|
| 2,029,566 | 2/1936 | Herzer | 128/201.25 |
| 2,222,635 | 11/1940 | Smith | 128/201.25 |
| 3,535,707 | 10/1970 | Greenlee | 128/200.27 |
| 3,649,964 | 3/1972 | Schoelz et al. | 128/205.25 |
| 3,822,698 | 7/1974 | Guy | 128/201.25 |
| 3,963,021 | 6/1976 | Bancroft | 128/201.25 |
| 4,133,308 | 1/1979 | Lowe et al. | 128/201.25 |
| 4,136,688 | 1/1979 | Gorman | 128/201.25 |
| 4,227,520 | 10/1980 | Lord | 128/201.25 |
| 4,280,491 | 7/1981 | Berg et al. | 128/201.25 |
| 4,331,141 | 5/1982 | Pokhis | 128/205.25 |
| 4,336,799 | 6/1982 | Almasi | 128/201.25 |
| 4,350,507 | 9/1982 | Greenough et al. | 128/201.25 |
| 4,462,399 | 7/1984 | Braun | 128/201.25 |
| 4,549,542 | 10/1985 | Chien | 128/201.25 |

FOREIGN PATENT DOCUMENTS

| | | | |
|---|---|---|---|
| 2032284 | 5/1980 | United Kingdom | 128/201.25 |
| 1574311 | 9/1980 | United Kingdom | 128/201.25 |
| 2063074 | 6/1981 | United Kingdom | 128/201.25 |
| 463453 | 4/1975 | U.S.S.R. | 128/201.25 |
| 1068130 | 1/1984 | U.S.S.R. | 128/201.22 |

*Primary Examiner*—Edward M. Coven
*Assistant Examiner*—Karin M. Reichle
*Attorney, Agent, or Firm*—Lowe, Price, LeBlanc, Becker & Shur

[57] ABSTRACT

A helmet comprises a headshell, visor and a harness within which the head of the user is engagable. An auxiliary electrically operated service is provided, such as a lamp or air supply, operated by a switch actuated as the helmet is engaged or disengaged from the user's head. When the service is an air supply, the switch operates a fan motor which draws air into the helmet through a filter.

9 Claims, 2 Drawing Figures

HELMET WITH AUXILIARY, ELECTRICALLY OPERATED SERVICE

BACKGROUND OF THE INVENTION

This invention relates to protective helmets and, more particularly, to a helmet provided with an auxiliary electrically operated service such as a lamp or an air supply.

To achieve optimum usage of the auxiliary service provided on the helmet, it is important to conserve the electrical supply therefor. Operation of the auxiliary service, as may occur when manually operated switches are employed to switch the service on and off, at times when it is not strictly needed, is, therefore, to be avoided.

SUMMARY OF THE INVENTION

The present invention comprises a protective helmet including a headshell which in use extends over and serves to protect the forehead top and sides of the head of a user, a transparent visor mounted on the headshell and providing protection for the eyes and face of the user, a harness suspended from the headshell and which, during use, is adapted to engage the head of a user therein, an auxiliary electrically operated device, such as a lamp or air supply, provided on the headshell, a battery power source in electrical connection with the auxiliary device, and switch means for operating said auxiliary device by connection thereof to the power source and adapted to be actuated to switch said device into and out of operation as the helmet is respectively engaged upon and disengaged from the head of the user.

The invention further comprises a respirator helmet including a headshell which in use extends over and serves to protect the forehead top and sides of the head of a user, a transparent visor mounted on the headshell and providing protection for the eyes and face of the user, a harness suspended within the headshell and which, during use, is adapted to engage the head of a user therein, air supply means mounted within the headshell and comprising a motor operated fan and a filter through which said fan enables air to be drawn into the helmet; a battery power source electrically connected with said motor operated fan and switch means for operating said motor operated fan by connection thereof to the power source and adapted to be actuated to switch the fan motor on and off as the helmet is respectively engaged upon and disengaged from the head of a user.

Suitable curtain means are provided which are hermetically attached to margins of the headshell and visor and are adapted to extend around the sides and back of the head of the user and, adjacent a free edge thereof, are provided with means for effecting engagement of said curtain means round the neck of the user. Advantageously an exhalation valve is provided on the helmet. Preferably, the exhalation valve is provided on the visor at a location below the user's mouth and nose.

Advantageously, power supply means for the auxiliary service are also provided by rechargeable battery means located in the headshell.

In one form of the invention, the switch means comprises micro-switch mounted on the headshell and having a pivotal actuating arm which is spring biased to extend within the harness when the helmet is not in use and is displaced to energise the auxiliary service as the user's head engages in the harness.

In a further form of the invention, the switch means comprises a pressure sensitive switch mounted in relation to the headhsell and the harness so as to be compressed to energise the auxiliary service as the user's head engages the harness.

BRIEF DESCRIPTION OF THE DRAWING

The invention will now be described by way of example with reference to the accompanying drawings, in which.

DETAILED DESCRIPTION OF THE INVENTION

Figure 1:
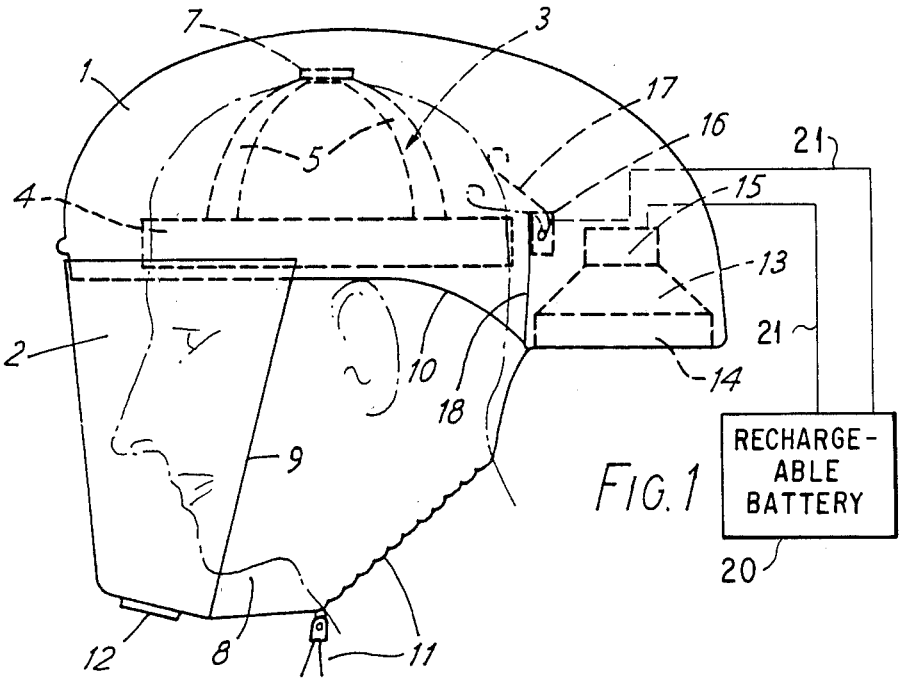
FIG. 1 is a diagrammatic side elevation of a respirator helmet according to the invention with the battery schematically depicted outside the helmet for clarity.

In the drawings like reference numerals are employed to designate like parts.

Figure 2:
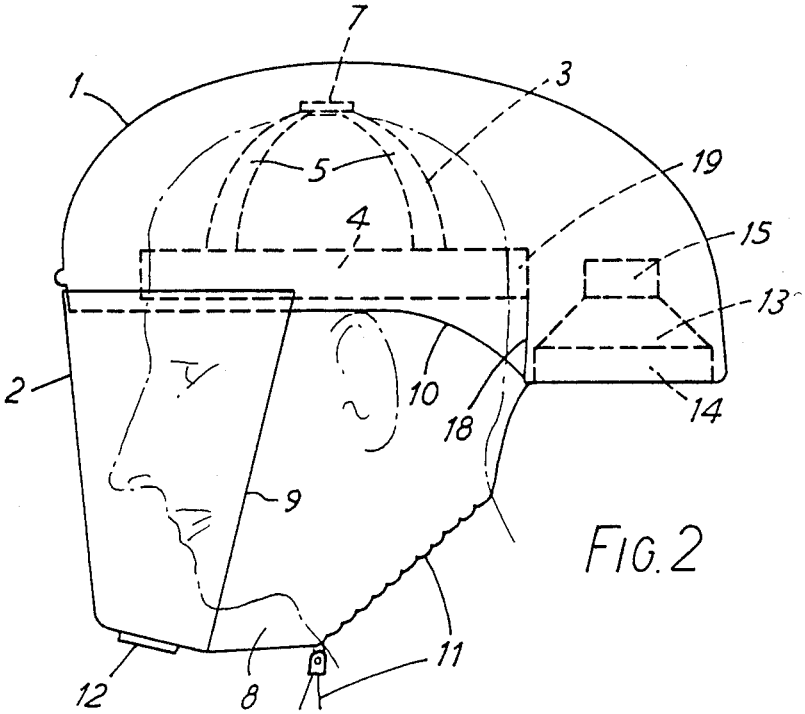
FIG. 2 is a diagrammatic side elevation of a modified respirator helmet according to the invention.

Although the helmets shown in FIGS. 1 and 2 are respirator helmets such as may be used in dust or vapour contaminated atmospheres, those skilled in the art will appreciate that the invention is applicable to helmets provided with an auxiliary electrically operated service, e.g. a lamp, other than an air supply.

Referring to FIG. 1, a respirator helmet comprises a headshell 1 having a visor 2 fixed relatively to the headshell and a head harness or cradle 3 suspended within the headshell which comprises a headband 4 secured to the headhshell and arcuate strap members 5 by means of which the headband 4 is attached to a fixing element 7 which suspends the harness at the top thereof from the shell.

Curtain means 8 is secured hermetically at marginal edges thereof to a rear edge 9 of the visor and a lower edge 10 of the headshell. Remote from the edges 9 and 10, the curtain means at the free edge thereof is provided with a drawstring 11. The curtain means thus extends around the sides and back of the wearer's head, illustrated in broken outline, and the drawstring is operable to draw the free edge of the curtain means into contact with the wearer's neck so as to inhibit the flow of noxious fumes into the helmet.

At a lower end of the visor 2 is provided an exhalation valve 12 located below the user's nose and mouth for the passage to the ambient atmosphere of exhaled breath of the user.

Air supply means 13 is provided and mounted in a part of the headshell at the rear of the user's head and comprise a filter 14 and electric motor operated fan 15 which serves to draw air into the headshell from the atmosphere by way of the filter 14. A power supply 20 (FIG. 1 only) for the motor of the fan 15 comprises a bank of rechargeable batteries (block diagram illustrations) which are mounted within the headshell. The supply 20, motor and switch 16 are connected via leads 21 (FIG. 1 only).

To energise the motor of the fan, there is provided a switch means which, in the embodiment of FIG. 1, is in the form of a micro-switch 16 having a spring biased actuating arm 17 which, when the helmet is not in use, extends within the harness 3 above the headband 4. The micro-switch 16 is mounted on a rigid intergral part 18 of the shell 1 located at the centre back of the user's head. When the helmet is mounted on the head of the user, as the user's head passes into the harness through the headband 4, the arm 17 is engaged by the user's head and swung upwardly and rearwardly. As a result of such movement, the micro-switch contacts are made and the power supply is connected to the motor of the fan which commences to draw air from the external atmosphere into the body of the helmet. The drawstring 11 is pulled to bring the free edge of the curtain means into contact with the neck of the wearer. The flow of air through the filter 14 into the helmet is controlled so as to maintain a slight positive air pressure within the body of the helmet and thereby prevent the flow into the helmet of fumes from the external atmosphere. On removal of the helmet, the drawstring 11 is slackened and the helmet is lifted from the head of the wearer. During this movement, the spring bias of the arm 17 returns the arm to its initial position thereby switching off the power supply to the fan motor.

In the embodiment depicted in FIG. 2, instead of a micro-switch, there is employed a pressure sensitive switch 19 which is mounted on the integral part 18 of the headshell between that part and the headband 4. Thus, when the helmet is placed on the head of the user, as the head of the user engages within the harness 3, the switch 19 is compressed so as to actuate the motor of the fan 15 and thus initiate the supply of air to the interior of the helmet. Removal of the helmet from the head of the user removes the compressive force acting on the pressure sensitive switch 19 with the result that the power supply is disconnected from the motor of the fan 15.

In the embodiments of the invention described, as the auxiliary service is switched on and off as the helmet is engaged on and disengaged from the head of the wearer, the use of power is kept to a minimum so that where the power supply is in the form of rechargeable batteries, the maximum effective use of the auxiliary service per charge of the batteries is made. Also, from the safety point of view, because the switch is disposed internally of the helmet, accidental switching on or off of the power is not as likely to take place as in the case where the switch is mounted on the exterior of the helmet, thus the attendant risk of danger to the user of the helmet is minimised.

What is claimed is:

1. A protective helmet comprising a headshell which in use extends over and serves to protect the forehead top and sides of the head of a user, transparent visor means mounted on the headshell and providing protection for the eyes and face of the user, a harness suspended from the headshell and which, during use, is adapted to engage the head of the user therein, an auxiliary electrically operated device, provided on the headshell, a battery power source in electrical connection with the auxiliary device, and switch means mounted within the helmet for operating said auxiliary device by connection thereof to the power source, said switch means mounted proximate to the harness to switch said device into and out of operation as the head of the user is respectively engaged within and disengaged from said harness.

2. A respirator helmet comprising a headshell which in use extends over and serves to protect the forehead top and sides of the head of a user, transparent visor means mounted on the headshell and providing protection for the eyes and face of the user, a harness suspended within the headshell and which, during use, is adapted to engage the head of a user therein, air supply means mounted within the headshell for supplying air into the helmet; a battery power source electrically connected with said air supply means and switch means mounted within the helmet for operating said air supply means by connection thereof to the power source, said switch means mounted proximate the harness to switch the air supply means on and off as the head of the user is respectively engaged within and disengaged from said harness.

3. A protective helmet comprising a headshell, visor means mounted to the headshell, a harness suspended within the headshell and mounted to an interior wall thereof, said harness engaging a wearer's head during use of the protective helmet, an auxiliary electrically operated device, a battery power source and in electrical connection with said auxiliary device, and switch means for operating said auxiliary device by electrical connection thereto and to the power source, said switch means including means for sensing the presence of the wearer's head being disposed within the harness causing actuation of said auxiliary device when the wearer's head is disposed within the protective helmet irrespective of the inclination of said wearer's head relative to an external reference point.

4. A protective helmet comprising a headshell which in use extends over and serves to protect the forehead top and sides of the head of a user, transparent visor means mounted on the headshell for providing protection for the eyes and face of the user, a harness suspended from the headshell and which, during use, is adapted to engage the head of a user therein, an auxiliary electrically operated device, provided on the headshell, a battery power source in electrical connection with the auxiliary device, and switch means for operating said auxiliary device by connection thereof to the power source and adapted to be actuated to switch said device into and out of operation as the head of the user is respectively engaged within and disengaged from said harness, said switch means comprising a micro-switch mounted in the headshell and having a pivotal actuating arm means extending within the harness when the helmet is not in use and displaceable to energize the auxiliary device as the head of the user is engaged within the harness.

5. A helmet as claimed in claim 4, wherein the micro-switch is mounted on the headshell at the centre back thereof.

6. A protective helmet comprising a headshell which in use extends over and serves to protect the forehead top and sides of the head of a user, transparent visor means mounted on the headshell for providing protection for the eyes and face of the user, a harness suspended from the headshell and which, during use, is adapted to engage the head of a user therein, an auxiliary electrically operated device, provided on the headshell, a battery power source in electrical connection with the auxiliary device, and switch means for operating said auxiliary device by connection thereof to the power source and adapted to be actuated to switch said device into and out of operation as the head of the user is respectively engaged within and disengaged from said harness, said switch means comprising a pressure sensitive switch mounted in relation to the headshell and the harness so as to be compressed and thereby actuated to energize the auxiliary device as the head of the user is engaged within the harness.

7. A helmet as claimed in claim 6, wherein the pressure sensitive switch means are disposed between the harness and an integral part of the headshell disposed at the centre back thereof.

8. A respirator helmet comprising a headshell which in use extends over and serves to protect the forehead top and sides of the head of a user, transparent visor means mounted on the headshell for providing protection for the eyes and face of the user, a harness suspended within the headshell and which, during use, is adapted to engage the head of a user therein, air supply means mounted within the headshell and comprising a motor operated fan, air inlet means in the headshell and a filter mounted in communication with said air inlet means through which air inlet means said fan enables air to be drawn into the helmet through the filter, a battery power source electrically connected with said motor operated fan and switch means for operating said motor operated fan by connection thereof to the power source and adapted to be actuated to switch the fan motor on and off as the head of the user is respectively engaged within and disengaged from said harness, said switch means comprising a micro-switch mounted in the headshell and having a pivotal actuating arm means extending within the harness when the helmet is not in use and which said arm means can be pivotally displaced to energize the motor operated fan as the head of the user is engaged within the harness.

9. A respirator helmet comprising a headshell which in use extends over and serves to protect the forehead top and sides of the head of a user, transparent visor means mounted on the headshell for providing protection for the eyes and face of the user, a harness suspended within the headshell and which, during use, is adapted to engage the head of a user therein, air supply means mounted within the headshell for enabling air to be supplied into the helmet, a battery power source electrically connected with said air supply means and switch means for operating said air supply means by connection thereof to the power source and adapted to be actuated to switch the air supply means on and off as the head of the user is respectively engaged within and disengaged from said harness, said switch means comprising a pressure sensitive switch mounted in relation to the headshell and the harness so as to be compressed and thereby actuated to energize the air supply means as the head of the user is engaged within the harness.

* * * * *